US008564585B2

(12) United States Patent
Lee et al.

(10) Patent No.: US 8,564,585 B2
(45) Date of Patent: Oct. 22, 2013

(54) SOURCE DRIVER AND DISPLAY DEVICE WITH PROTECTION UNIT

(75) Inventors: Chuan-Che Lee, Tainan County (TW); Chien-Ru Chen, Tainan County (TW)

(73) Assignee: Himax Technologies Limited, Tainan (TW)

( * ) Notice: Subject to any disclaimer, the term of this patent is extended or adjusted under 35 U.S.C. 154(b) by 308 days.

(21) Appl. No.: 12/963,872

(22) Filed: Dec. 9, 2010

(65) Prior Publication Data

US 2012/0146976 A1 Jun. 14, 2012

(51) Int. Cl.
*G09G 5/00* (2006.01)

(52) U.S. Cl.
USPC ..... 345/211; 345/98

(58) Field of Classification Search
USPC ..... 345/211–215, 204, 98–100; 349/72, 349/139, 149
See application file for complete search history.

(56) References Cited

U.S. PATENT DOCUMENTS

| | | | | |
|---|---|---|---|---|
| 5,198,747 | A * | 3/1993 | Haight | 323/303 |
| 2005/0068214 | A1* | 3/2005 | Kim | 341/144 |
| 2008/0278473 | A1* | 11/2008 | An | 345/214 |
| 2011/0316823 | A1* | 12/2011 | Otani et al. | 345/204 |

FOREIGN PATENT DOCUMENTS

JP 2002351426 A * 12/2002

* cited by examiner

*Primary Examiner* — Liliana Cerullo
(74) *Attorney, Agent, or Firm* — J.C. Patents

(57) ABSTRACT

A source driver for driving a display panel and including a protection unit, a bias voltage generation unit and a buffer is provided. The protection unit detects a characteristic parameter of the source driver, and generates a switching signal according to a detection result. The bias voltage generation unit determines whether or not to provide a bias voltage according to the switching signal. The buffer is operated in the bias voltage so as to drive pixels in the display panel.

16 Claims, 5 Drawing Sheets

SOURCE DRIVER AND DISPLAY DEVICE WITH PROTECTION UNIT

BACKGROUND

1. Field of the Invention

The invention relates to a source driver and a display device. Particularly, the invention relates to a source driver having an over current protection mechanism and a display device using the same.

2. Description of Related Art

FIG. 1 is a structural schematic diagram illustrating a conventional liquid crystal display (LCD). Referring to FIG. 1, the conventional LCD 100 includes a display panel 110, a plurality of source drivers 121-126 and a power controller 130. The power controller 130 is disposed on a printed circuit board (PCB) 140, and supplies power to the source drivers 121-126 through a resistor R1. The source drivers 121-126 are packaged on flexible circuit boards 151-156 through chip on flex (COF) bonding structures, and receive the power from the power controller 130. In this way, the source drivers 121-126 can convert digital image data into corresponding driving voltages to drive pixels in the display panel 110.

Moreover, in the conventional LCD 100, an over current protection circuit 160 is generally disposed in the power controller 130, and a main reason thereof is that during an assembling process of a LCD, poor wire bonding generally causes unnecessary short circuit between the wires. For example, during a packaging process of the source drivers 121-126, originally independent output channels are probably connected due to the poor wire bonding. Now, the shorted output channels may cause the source drivers generating a large current to damage the internal circuit.

To avoid occurrence of the above problem, when the large current is generated, the over current protection circuit 160 can cut off the power supplied by the power controller 130. In this way, all of the source drivers 121-126 stop operations, so as to avoid being damaged by the large current. However, although such over current protection method can protect the system, it also increases difficulty in testing of the display, since when the over current protection mechanism is activated, all of the source drives stop operations, so that it is hard for a testing engineer to determine the malfunctioned source driver or a block that has a connection problem. Now, the testing engineer has to perform testing to each of the source drivers and related connections of each of the blocks. Therefore, not only a time required for testing the display is increased, but also a labour cost is increased.

SUMMARY OF THE INVENTION

Accordingly, the invention is directed to a source driver, which can stop operation when an over current is generated, so as to reduce a time required for testing.

The invention is directed to a display device, which can position a source of short-circuit through flicking of a panel, so as to reduce a labour cost used for testing the display device.

The invention provides a source driver, which is used for driving a display panel, and includes a protection unit, a bias voltage generation unit and a buffer. The protection unit detects a characteristic parameter of the source driver, and generates a switching signal according to a detection result. The bias voltage generation unit determines whether or not to provide a bias voltage according to the switching signal. The buffer is operated in the bias voltage so as to drive pixels in the display panel.

In an embodiment of the invention, the bias voltage generation unit includes a bandgap reference circuit, a switch and a bias voltage circuit. The bandgap reference circuit provides a bandgap current. The switch has a first end and a second end. Moreover, the first end of the switch receives the bandgap current, and the switch determines whether or not to conduct the first end and the second end according to the switching signal. The bias voltage circuit is electrically connected to the second end of the switch, and generates the bias voltage when receiving the bandgap current.

In an embodiment of the invention, the protection unit includes an inverter, a voltage-dividing circuit, a sensing circuit and a comparator. The inverter receives the switching signal and generates an inverting signal of the switching signal. The voltage-dividing circuit generates a plurality of divided voltages according to a bandgap voltage non-related to temperature, and selects one of the divided voltages to serve as a reference voltage according to the switching signal and the inverting signal of the switching signal. The sensing circuit detects the characteristic parameter of the source driver, and generates a sensing voltage according to a detection result. The comparator compares the sensing voltage and the reference voltage, and generates the switching signal according to a comparison result.

According to another aspect, the invention provides a display device including a display panel and a source driver. The source dirtier includes a protection unit, a bias voltage generation unit and a buffer. The protection unit detects a characteristic parameter of the source driver, and generates a switching signal according to a detection result. The bias voltage generation unit determines whether or not to provide a bias voltage according to the switching signal. The buffer is operated in the bias voltage so as to drive pixels in the display panel.

According to the above descriptions, in the invention, the protection unit in the source driver is used to detect an over current, so that the source driver can automatically stop operation when the over current is occurred. In this way, the source driver causing the over current may lead to flicking of a certain block of the display panel. Therefore, a testing engineer can immediately position a source of shorted wires, so as to greatly reduce a time required for testing the display device and save a labour cost used for testing the display device.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
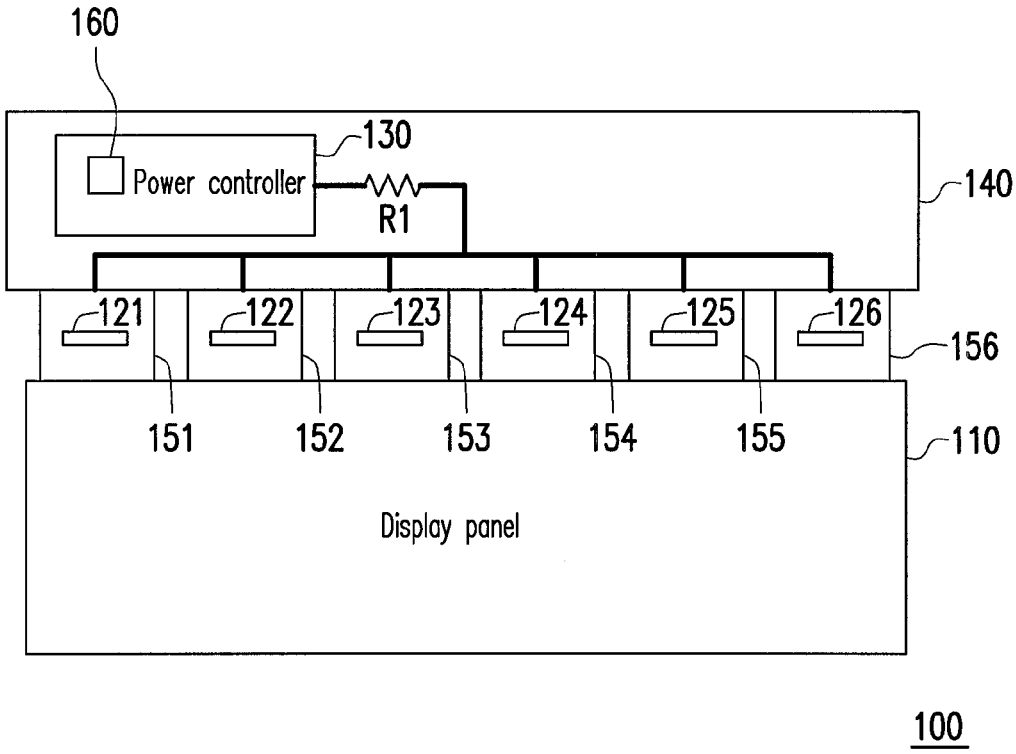
FIG. 1 (PRIOR ART)
FIG. 1 is a structural schematic diagram illustrating a conventional liquid crystal display (LCD).
Figure 2:
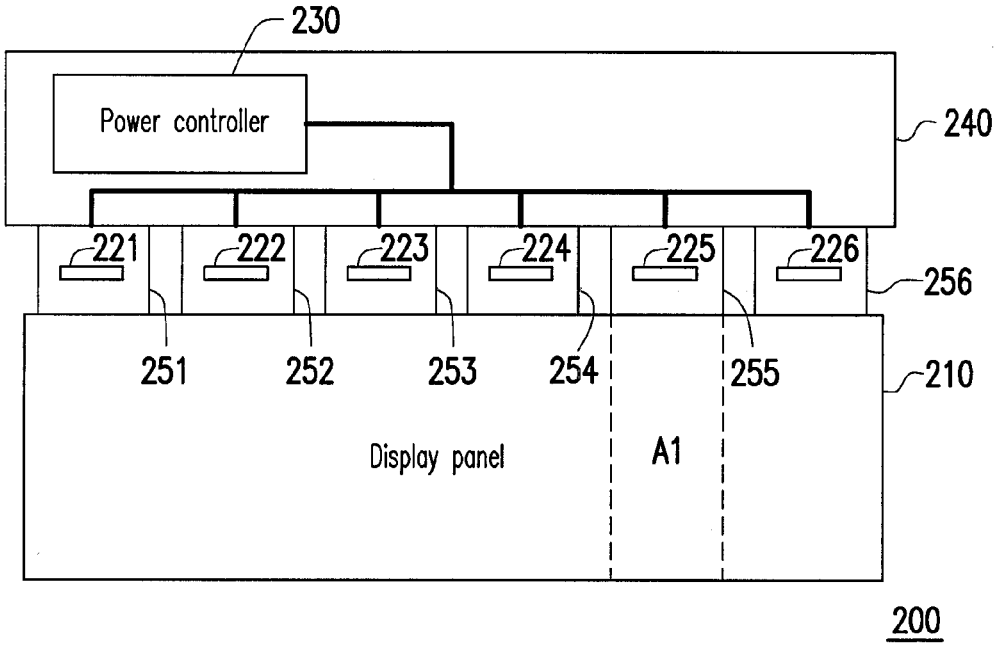
FIG. 2 is a schematic diagram illustrating a display device according to an embodiment of the invention.

FIG. 2 is a schematic diagram illustrating a display device according to an embodiment of the invention. Referring to FIG. 2, the display device 200 includes a display panel 210, a plurality of source drivers 221-226 and a power controller 230. The power controller 230 is disposed on a printed circuit board 240, and the source drivers 221-226 are packaged on flexible circuit boards 251-256 through chip on flex (COF) bonding structures. During operation, the power controller 230 supplies power to the source drivers 221-226. In this way, the source drivers 221-226 can convert digital image data into corresponding driving voltages to drive pixels (not shown) in the display panel 210.

On the other hand, each of the source drivers 221-226 has a protection unit. Therefore, when poor wire bonding causes unnecessary short circuit, the source driver causing a large current may automatically stop operation, and the source drivers without causing the large current can normally operate. For example, when the source driver 225 generates the large current due to short circuit of the wires, the source driver 225 stops operating, while the other source drivers 221-224 and 226 can normally operate. Now, in the display panel 210, a block A1 driven by the source driver 225 produces flicker. Therefore, a testing engineer may perform testing to the source driver 225 and related connections of the block A1, so as to repair the display device 200.

To fully convey the spirit of the invention to those skilled in the art, the source driver 225 is taken as an example for describing operations of the source driver.

Figure 3:
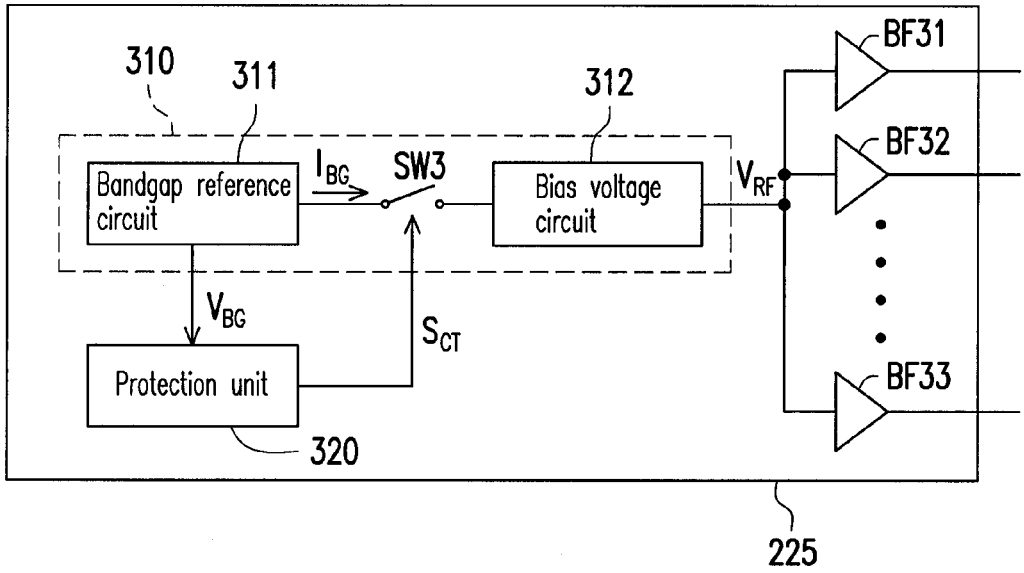
FIG. 3 is a schematic diagram illustrating a source driver according to an embodiment of the invention.

FIG. 3 is a schematic diagram illustrating a source driver according to an embodiment of the invention. Referring to FIG. 3, the source driver 225 includes a bias voltage generation unit 310, a protection unit 320 and a plurality of buffers BF31-BF33. Moreover, the bias voltage generation unit 310 includes a bandgap reference circuit 311, a bias voltage circuit 312 and a switch SW3. The protection unit 320 is electrically connected to the bandgap reference voltage 311. A first end of the switch SW3 is electrically connected to the bandgap reference circuit 311, and a second end of the switch SW3 is electrically connected to the bias voltage circuit 312. The bias voltage circuit 312 is electrically connected to the buffers BF31-BF33.

In view of a whole operation, the bandgap reference circuit 311 generates a bandgap current $I_{BG}$ non-related to temperature. The first end of the switch SW3 receives the bandgap current $I_{BG}$, and the switch SW3 determines whether or not to conduct the first end and the second end according to a switching signal $S_{CT}$. In this way, when the switch SW3 is conducted, the bandgap current $I_{BG}$ is transmitted to the bias voltage circuit 312, so that the bias voltage circuit 312 generates a bias voltage $V_{RF}$. Comparatively, when the switch SW3 is not conducted, the bias voltage circuit 312 cannot receive the bandgap current $I_{BG}$, and accordingly cannot generate the bias voltage $V_{RF}$.

On the other hand, the bandgap reference circuit 311 further generates a bandgap voltage $V_{BG}$ non-related to temperature, so that the protection unit 320 can generate a plurality of divided voltages non-related to temperature according to the bandgap voltage $V_{BG}$. Furthermore, the protection unit 320 detects a characteristic parameter of the source driver 225, and generates the switching signal $S_{CT}$ according to a detection result, wherein the characteristic parameter is, for example, a temperature or a total current of the source driver 225. Since he temperature of the source driver 225 is proportional to the total current thereof, the temperature or the total current of the source driver 225 can be used as a comparison parameter of an over current protection mechanism.

When the source driver 225 generates an over current due to short circuit of wires, i.e. when the temperature of the source driver 225 increases, the protection unit 320 generates the switching signal $S_{CT}$ having a first logic level (for example, logic 1), so that the switch SW3 cannot be conducted. In this way, the bias voltage circuit 312 cannot supply the bias voltage $V_{RF}$ to the buffers BF31-BF33, so that the source driver 225 cannot normally operate.

Moreover, the temperature or the total current of the source driver 225 can be slowly decreased as the source driver 225 stops the operation. When the temperature or the total current of the source driver 225 is decreased to a predetermined value, the protection unit 320 generates the switching signal $S_{CT}$ having a second logic level (for example, logic 0), so that the switch SW3 is conducted. Now, the bias voltage circuit 312 supplies the bias voltage $V_{RF}$ to the buffers BF31-BF33, so that the source driver 225 can normally drive the post-end pixels.

Similarly, when the source driver 225 again generates the over current, the protection unit 320 again turns off the bias voltage $V_{RF}$ supplied by the bias voltage generation unit 310, so as to again disables the source driver 225. By repeatedly enabling/disabling the source driver 225, the block A1 driven by the source driver 225 produces flicker. Therefore, the testing engineer may perform testing to the source driver 225 and related connections of the block A1, so as to repair the display device 200.

It should be noticed that in the present embodiment, the switch SW3 is used to control a conducting path between the bandgap reference circuit 311 and the bias voltage circuit 312, so that the bias voltage generation unit 310 can determine whether or not to provide the bias voltage $V_{RF}$ according to the switching signal $S_{CT}$. However, during an actual application, those skilled in the art can also select the bias voltage generation unit 310 of a different structure according to the spirit of the invention.

For example, the switch SW3 in the bias voltage generation unit 310 can be removed. Now, the bias voltage generation unit 310 can control the operation of the bandgap reference circuit 311 through the switching signal $S_{CT}$. In this way, when the bandgap reference circuit 311 normally operates, the bias voltage generation unit 310 supplies the bias voltage V. Comparatively, when the bandgap reference circuit 311 stops operating, the bias voltage generation unit 310 cannot supply the bias voltage $V_{RF}$ to the buffers BF31-BF33.

To fully convey the operation of the source drive to those skilled in the art, the protection unit 320 and the bias voltage circuit 312 in the source driver 225 are respectively described in detail below.

Figure 4:
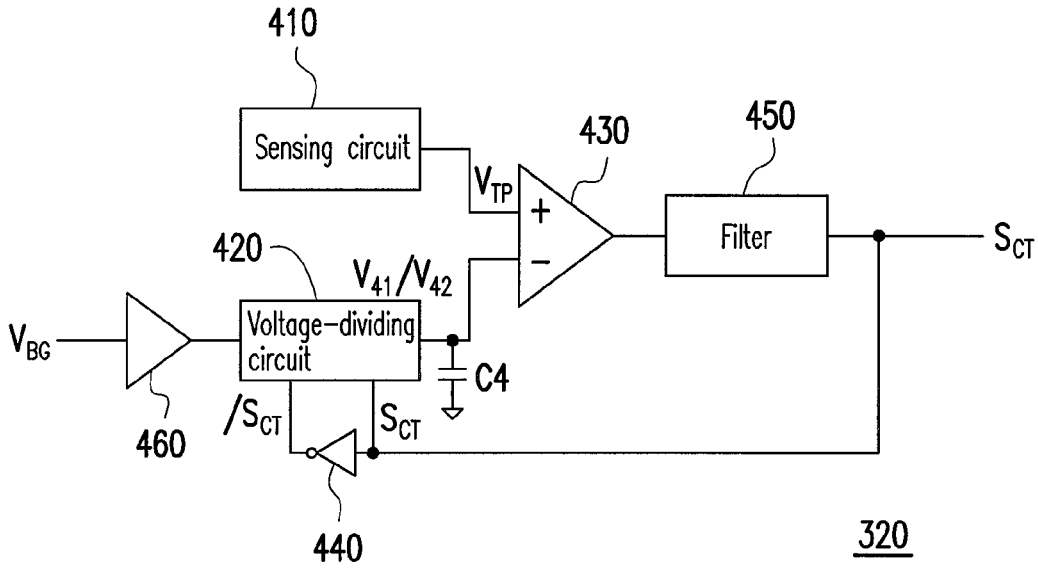
FIG. 4 is a schematic diagram illustrating a protection unit according to an embodiment of the invention.

FIG. 4 is a schematic diagram illustrating a protection unit according to an embodiment of the invention. Referring to FIG. 4, the protection unit 320 includes a sensing circuit 410, a voltage-dividing circuit 420, a comparator 430, an inverter 440, a filter 450 and an amplifier 460. The amplifier 460 receives a bandgap voltage $V_{BG}$ non-related to temperature, and amplifies the bandgap voltage $V_{BG}$ and outputs it to the voltage-dividing circuit 420. Moreover, the bandgap voltage $V_{BG}$ can be provided by the bandgap reference circuit 311 in the bias voltage generation unit 310.

Moreover, the voltage-dividing circuit 420 generates a plurality of divided voltages, for example, $V_{41}$ and $V_{42}$ according to the bandgap voltage $V_{BG}$. In addition, the voltage-dividing circuit 420 selects one of the divided voltages $V_{41}$ and $V_{42}$ to serve as a reference voltage according to the switching signal $S_{CT}$ and an inverting signal $/S_{CT}$ of the switching signal $S_{CT}$. The inverting signal $/S_{CT}$ of the switching signal $S_{CT}$ is generated by the inverter 440. Here, an input terminal of the inverter 440 receives the switching signal $S_{CT}$, and an output terminal of the inverter 440 generates the inverting signal $/S_{CT}$ of the switching signal $S_{CT}$ to the voltage-dividing circuit 420.

On the other hand, the sensing circuit 410 detects the characteristic parameter of the source driver 225, and generates a sensing voltage $V_{TP}$ according to a detection result. Moreover, an input terminal of the comparator 430 receives the sensing voltage $V_{TP}$, and another input terminal of the comparator 430 receives the reference voltage (for example, $V_{41}$ or $V_{42}$). In this way, the comparator 430 compares the sensing voltage $V_{TP}$ and the reference voltage (for example, $V_{41}$ or $V_{42}$), and generates the switching signal $S_{CT}$ according to a comparison result.

Moreover, to increase an output characteristic of the protection unit 320, a capacitor C4 is electrically connected to the output of the voltage-dividing circuit 420, and the filter 450 is connected behind the comparator 430 in series. In this way, the protection unit 320 can filter a noise of the switching signal $S_{CT}$ through the filter 450, and then outputs the filtered switching signal $S_{CT}$ to the inverter 440 and the voltage-dividing circuit 420.

Figure 5:
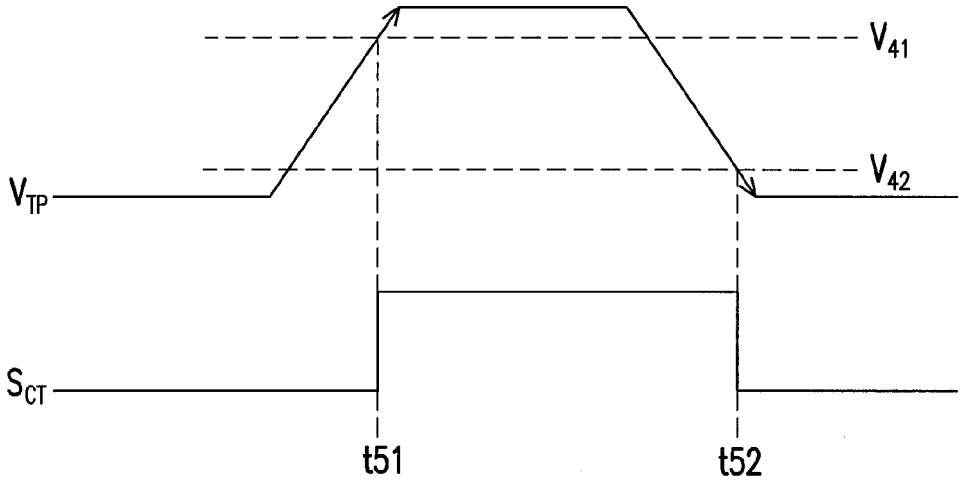
FIG. 5 is a timing diagram of the protection unit of FIG. 4.

FIG. 5 is a timing diagram of the protection unit of FIG. 4. How the protection unit 320 controls the logic level of the switching signal $S_{CT}$ is described with reference of FIG. 4 and FIG. 5. In the beginning, assuming the switching signal $S_{CT}$ has a state of logic 0, and the voltage-dividing circuit 420 outputs the divided voltage $V_{41}$ (for example, 1.8V) to serve as the reference voltage. Here, when the source driver 225 generates the over current due to short circuit of the wires, the sensing voltage $V_{TP}$ generated by the sensing circuit 410 is gradually increased. Moreover, at a time point t51 of FIG. 5, when the sensing voltage $V_{TP}$ is gradually increased and is greater than the divided voltage $V_{41}$, the sensing voltage $V_{TP}$ is now greater than the reference voltage, so that the comparator 430 switches the state of the switching signal $S_{CT}$ to logic 1.

Moreover, the switching signal $S_{CT}$ having the state of logic 1 is feedback to the voltage-dividing circuit 420, so that the voltage-dividing circuit 420 reselects the divided voltage $V_{42}$ (for example, 0.8V) to serve as the reference voltage. On the other hand, the bias voltage generation unit 310 stops providing the bias voltage $V_{RF}$ according to the switching signal $S_{CT}$ having the state of logic 1, so that the source driver 225 stops operating. Now, the current of the source driver 225 starts to decrease, and as the current of the source driver 225 is decreased, the sensing voltage $V_{TP}$ generated by the sensing circuit 410 is also decreased, continually.

Moreover, at a time point t52 of FIG. 5, when the sensing voltage $V_{TP}$ is continually decreased to be smaller than the divided voltage V42, the sensing voltage $V_{TP}$ is now smaller than the reference voltage, so that the comparator 430 switches back the state of the switching signal $S_{CT}$ to logic 0. In this way, the bias voltage generation unit 310 can supply the bias voltage $V_{RF}$ according to the switching signal $S_{CT}$ having the state of logic 0, so that the source driver 225 can normally operate.

Figure 6A:
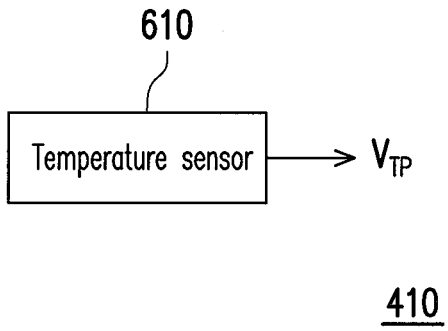
FIG. 6A is a schematic diagram illustrating a sensing circuit according to an embodiment of the invention.
Figure 6B:
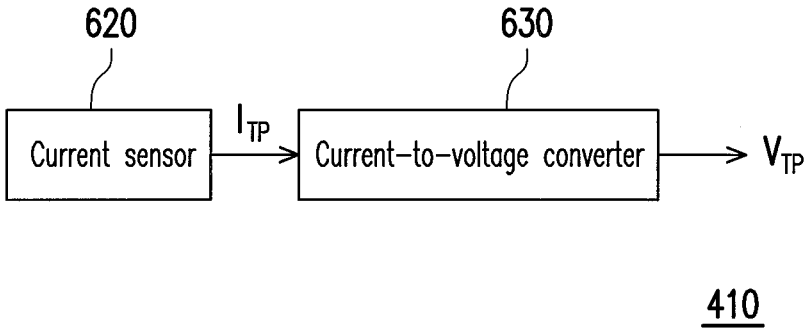
FIG. 6B is a schematic diagram illustrating a sensing circuit according to another embodiment of the invention.

FIG. 6A and FIG. 6B are schematic diagrams illustrating sensing circuits according to an embodiment of the invention.

In FIG. 6A, the sensing circuit 410 includes a temperature sensor 610. The temperature sensor 610 senses a temperature of the source driver 225, and accordingly generates the sensing voltage $V_{TP}$. In other words, the protection unit 320 determines whether the source driver 225 generates the over current by detecting the temperature of the source driver 225.

On the other hand, as shown in FIG. 6B, the sensing circuit 410 includes a current sensor 620 and a current-to-voltage converter 630. The current sensor 620 senses the total current of the source driver 225, and accordingly generates a sensing current $I_{TP}$. The current-to-voltage converter 630 converts the sensing current $I_{TP}$ into the sensing voltage $V_{TP}$. In other words, the protection unit 320 determines whether the source driver 225 generates the over current by detecting the total current of the source driver 225.

Figure 7:
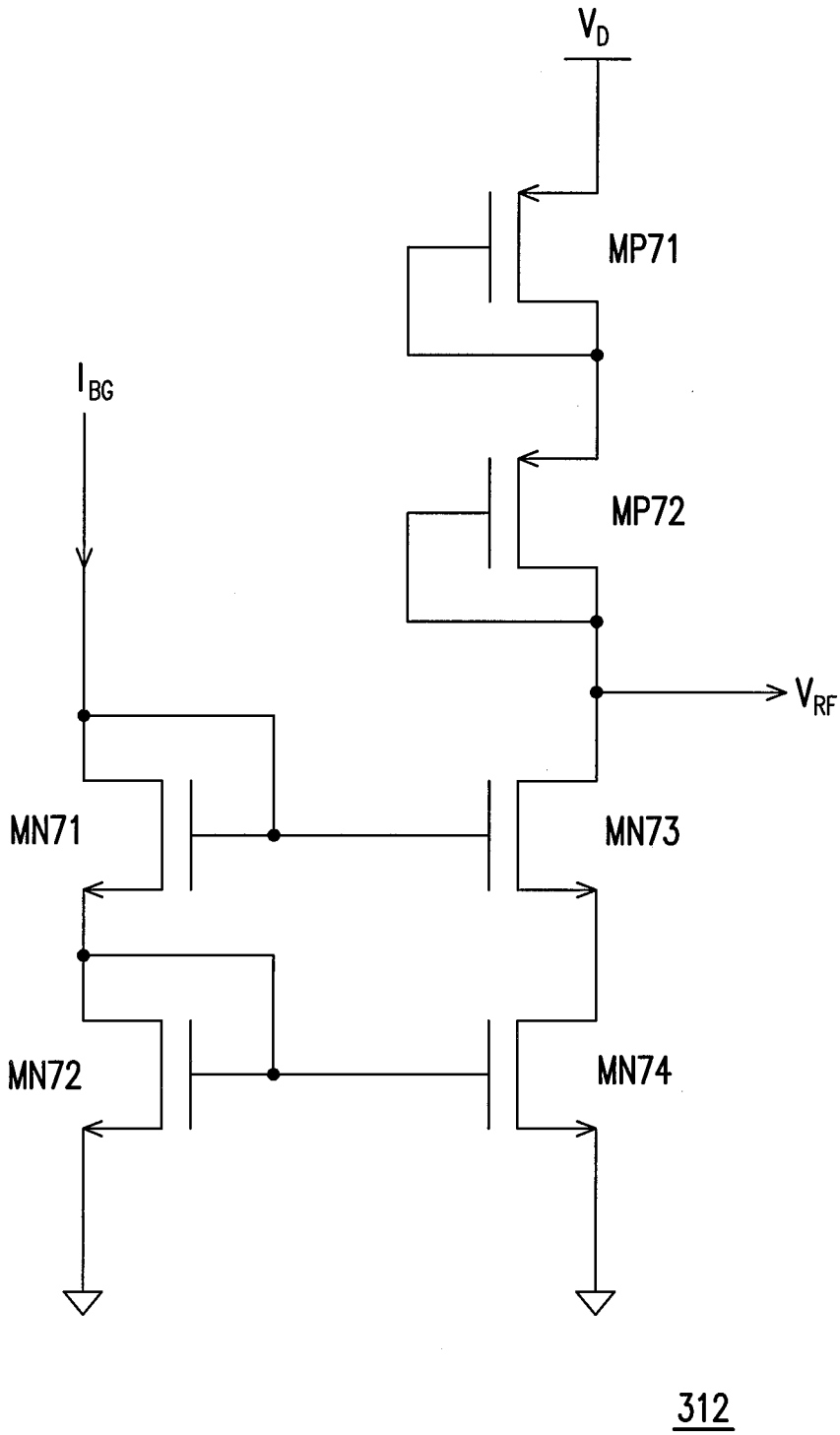
FIG. 7 is a schematic diagram illustrating a bias voltage circuit according to an embodiment of the invention.

FIG. 7 is a schematic diagram illustrating a bias voltage circuit according to an embodiment of the invention. Referring to FIG. 7, the bias voltage circuit 312 includes N-channel transistors MN71-MN74 and P-channel transistors MP71-MP72. A drain of the N-channel transistor MN71 is electrically connected to the second end of the switch SW3 for receiving the bandgap current $I_{BG}$. Moreover, a gate of the N-channel transistor MN71 is electrically coupled to the drain thereof. In addition, a drain of the N-channel transistor MN72 is electrically connected to a source of the N-channel transistor MN71, a gate of the N-channel transistor MN72 is electrically coupled to the drain thereof, and a source of the N-channel transistor MN72 is electrically connected to ground.

Moreover, a gate of the N-channel transistor MN73 is electrically connected to the gate of the N-channel transistor MN71. A drain of the N-channel transistor MN74 is electrically connected to a source of the N-channel transistor MN73, a gate of the N-channel transistor MN74 is electrically coupled to the gate of the N-channel transistor MN72, and a source of the N-channel transistor MN74 is electrically coupled to ground.

Moreover, a source of the P-channel transistor MP71 receives a power voltage $V_D$, and a gate of the P-channel transistor MP71 is electrically coupled to a drain thereof. A source of the P-channel transistor MP72 is electrically connected to the drain of the P-channel transistor MP71, and a gate and a drain of the P-channel transistor MP72 are electrically coupled to the drain of the N-channel transistor MN73.

The N-channel transistors MN71-MN74 form a cascade current mirror. In this way, when the bandgap current $I_{BG}$ is supplied to the bias voltage circuit 312, the current mirror copies the bandgap current $I_{BG}$, and transmits it to the P-channel transistors MP71-MP72. Therefore, the bias voltage circuit 312 can generate the bias voltage $V_{RF}$ through the drain of the N-channel transistor MN73. Comparatively, when the bandgap current $I_{BG}$ cannot be supplied to the bias voltage circuit 312, the bias voltage circuit 312 cannot operate, so that the bias voltage $V_{RF}$ is not generated.

In summary, in the invention, the protection unit in the source driver is used to detect the over current, so as to disable the operation of the source driver when the over current is occurred. In this way, when the poor wire bonding causes unnecessary short circuit, the source driver causing the large current can automatically stop operation, and the source drivers without causing the large current can normally operate. Therefore, the source driver causing the large current may lead to flicking of a certain block of the display panel. Therefore, the testing engineer can immediately position a source of the shorted wires, so as to greatly reduce a time required for testing the display device and save a labour cost used for testing the display device.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A source driver, for driving a display panel, and comprising:

a protection unit, for detecting a characteristic parameter of the source driver, and generating a switching signal according to a detection result, wherein the protection unit comprises:

an inverter, for receiving the switching signal, and generating an inverting signal of the switching signal;

a voltage-dividing circuit, for generating a plurality of divided voltages according to a bandgap voltage non-related to temperature, and selecting one of the divided voltages to serve as a reference voltage according to the switching signal and the inverting signal of the switching signal;

a sensing circuit, for detecting the characteristic parameter of the source driver, and generating a sensing voltage according to the detection result; and a comparator, for comparing the sensing voltage and the reference voltage, and generating the switching signal according to a comparison result;

a buffer; and a bias voltage generation unit, for determining whether or not to provide a bias voltage to the buffer according to the switching signal, wherein the source driver drives pixels in the display panel through the buffer when the bias voltage generation unit provides the bias voltage to the buffer, and the source driver stops driving the pixels in the display panel when the bias voltage generation unit stops providing the bias voltage to the buffer.

2. The source driver as claimed in claim 1, wherein the bias voltage generation unit comprises:

a bandgap reference circuit, for providing a bandgap current;

a switch, having a first end and a second end, wherein the first end of the switch receives the bandgap current, and the switch determines whether or not to conduct the first end and the second end according to the switching signal; and a bias voltage circuit, electrically connected to the second end of the switch, and generating the bias voltage when receiving the bandgap current.

3. The source driver as claimed in claim 2, wherein the bias voltage circuit comprises:

a first N-channel transistor, having a drain electrically coupled to the second end of the switch, and a gate electrically coupled to the drain thereof;

a second N-channel transistor, having a drain electrically coupled to a source of the first N-channel transistor, a gate electrically coupled to the drain thereof, and a source electrically coupled to a ground;

a third N-channel transistor, having a drain generating the bias voltage, and a gate electrically coupled to the gate of the first N-channel transistor;

a fourth N-channel transistor, having a drain electrically coupled to a source of the third N-channel transistor, a gate electrically coupled to the gate of the second N-channel transistor, and a source electrically coupled to the ground.

a first P-channel transistor, having a source receiving a power voltage, and a gate electrically coupled to a drain thereof; and a second P-channel transistor, having a source electrically coupled to the drain of the first P-channel transistor, and a gate and a drain electrically coupled to the drain of the third N-channel transistor.

4. The source driver as claimed in claim 1, wherein the protection unit further comprises:

a filter, electrically connected to the comparator, for filtering a noise of the switching signal.

5. The source driver as claimed in claim 1, wherein the protection unit further comprises:

an amplifier, for receiving the bandgap voltage, and outputting the bandgap voltage to the voltage-dividing circuit.

6. The source driver as claimed in claim 1, wherein the sensing circuit comprises a temperature sensor, and the temperature sensor senses a temperature of the source driver and accordingly generates the sensing voltage.

7. The source driver as claimed in claim 1 wherein the sensing circuit comprises:

a current sensor, for sensing a total current of the source driver, and accordingly generating a sensing current; and a current-to-voltage converter, for converting the sensing current into the sensing voltage.

8. The source driver as claimed in claim 1, wherein the bias voltage generation unit further provides the bandgap voltage to the voltage-dividing circuit.

9. The source driver as claimed in claim 1, wherein the characteristic parameter of the source driver is a temperature or a total current of the source driver.

10. A display device, comprising:

a display panel; and a source driver, comprising:

a protection unit, for detecting a characteristic parameter of the source driver, and generating a switching signal according to a detection result, wherein the protection unit comprises:

an inverter, for receiving the switching signal, and generating an inverting signal of the switching signal;

a voltage-dividing circuit, for generating a plurality of divided voltages according to a bandgap voltage non-related to temperature, and selecting one of the divided voltages to serve as a reference voltage according to the switching signal and the inverting signal of the switching signal;

a sensing circuit, for detecting the characteristic parameter of the source driver, and generating a sensing voltage according to the detection result; and a comparator, for comparing the sensing voltage and the reference voltage, and generating the switching signal according to a comparison result;

a buffer; and a bias voltage generation unit, for determining whether or not to provide a bias voltage to the buffer according to the switching signal, wherein the source driver drives pixels in the display panel through the buffer when the bias voltage generation unit provides the bias voltage to the buffer, and the source driver stops driving the pixels in the display panel when the bias voltage generation unit stops providing the bias voltage to the buffer.

11. The display device as claimed in claim 10, wherein the bias voltage generation unit comprises:

a bandgap reference circuit, for providing a bandgap current;

a switch, having a first end and a second end, wherein the first end of the switch receives the bandgap current, and the switch determines whether or not to conduct the first end and the second end according to the switching signal; and a bias voltage circuit, electrically connected to the second end of the switch, and generating the bias voltage when receiving the bandgap current.

12. The display device as claimed in claim 10, wherein the protection unit further comprises:

a filter, electrically connected to the comparator, for filtering a noise of the switching signal; and an amplifier, for receiving the bandgap voltage, and outputting the bandgap voltage to the voltage-dividing circuit.

13. The display device as claimed in claim 10, wherein the sensing circuit comprises a temperature sensor, and the temperature sensor senses a temperature of the source driver and accordingly generates the sensing voltage.

14. The display device as claimed in claim 10, wherein the sensing circuit comprises:

a current sensor, for sensing a total current of the source driver, and accordingly generating a sensing current; and a current-to-voltage converter, for converting the sensing current into the sensing voltage.

15. The display device as claimed in claim 10, wherein the bias voltage generation unit further provides the bandgap voltage to the voltage-dividing circuit.

16. The display device as claimed in claim 10, wherein the characteristic parameter of the source driver is a temperature or a total current of the source driver.

* * * * *